United States Patent [19]

Kelley

[11] 3,971,213

[45] July 27, 1976

[54] PNEUMATIC BEAM PUMPING UNIT

[76] Inventor: Robert K. Kelley, 3944 Floyd Drive, Fort Worth, Tex. 76116

[22] Filed: Nov. 4, 1974

[21] Appl. No.: 520,430

Related U.S. Application Data

[63] Continuation-in-part of Ser. No. 355,577, April 30, 1973, abandoned.

[52] U.S. Cl. ..... 60/372; 60/398; 60/407; 91/218; 91/304; 74/589

[51] Int. Cl.[2] ..... F15B 21/06

[58] Field of Search ..... 60/369, 370, 371, 372, 60/373, 408, 412, 414, 413, 398, 407; 91/165, 166, 218, 220, 304, 314; 74/41, 589; 417/379

[56] References Cited

UNITED STATES PATENTS

| | | | |
|---|---|---|---|
| 1,619,474 | 3/1927 | Hubbard | 60/372 |
| 2,390,124 | 12/1945 | Ross | 60/372 |
| 2,564,285 | 8/1951 | Smith | 60/372 |
| 2,704,998 | 3/1955 | Day et al. | 60/369 X |
| 3,369,490 | 2/1968 | Hawk | 91/220 X |
| 3,412,646 | 11/1968 | Johnston | 91/290 X |

*Primary Examiner*—Edgar W. Geoghegan
*Attorney, Agent, or Firm*—Schapp and Hatch

[57] ABSTRACT

A walking beam pumping unit is provided for pumping liquid from wells having gas pressure therein. The unit is driven by gas pressure from the well reciprocating the piston of a pneumatic cylinder up and down to swing the walking beam correspondingly and pump the liquid from the well. Gas under pressure is directed from the wellhead through a two-way valve to the opposite ends of the hydraulic cylinder in alternating fashion, so the piston has power strokes in opposite direction. Each power stroke, besides moving the walking beam, serves to recompress the gas used for the preceding power stroke sufficiently to inject it into the sales line. The setting of the two-way valve is controlled by a pneumatic actuator supplied with gas under pressure from the wellhead and having a thimble valve responsive to the up and down movement of the walking beam by means of adjustable stops carried thereon. The horsehead is counterbalanced by weights or by a pneumatic cylinder attached to the horsehead and actuated by movement thereof to provide counter-balancing gas pressure. In one form of the invention, the counter-balancing gas pressure is stored in a hollow skid assembly.

25 Claims, 6 Drawing Figures

PNEUMATIC BEAM PUMPING UNIT

BACKGROUND OF THE INVENTION

The present invention relates to a PNEUMATIC BEAM PUMPING UNIT and is a continuation-in-part of my copending application, Ser. No. 355,577, filed Apr. 30, 1973 now expired.

In the field of pumps for oil wells, it has been the general practice to use gasoline or electric engines to drive the walking beam which operates the pump. Such devices have not proven to be entirely satisfactory because they require daily maintenance, and often the wells are located in remote and isolated areas which are inaccessible and difficult to supply with gasoline or electrical power. Maintenance problems are aggravated when weather is particularly bad, and energy supply requirements make gasoline or electric drive relatively inefficient and expensive. To use gasoline, the oil must be removed from the well, transported to a refinery, refined into gasoline and the gasoline transported back to the well site. To utilize electrical energy, the oil must be transported from the well, burned to provide heat energy, the heat energy must be converted to electrical energy, and the electrical energy must be transported by wires back to the well site.

Attempts have previously been made to eliminate outside energy sources by using the gas pressure from the well to pump out the oil. Among these attempts are the use of gas lift devices and direct pneumatically-actuated pumps, for example, see U.S. Pat. No. 3,412,646 issued Nov. 26, 1968 to Rufus B. Johnston. The direct pneumatic drive pumps are not capable of storing energy from the downstroke so this energy can be used to aid in the upstroke.

A further attempt has been made to utilize the energy storage feature of a walking beam pump in an apparatus driven by gas under pressure from the wellhead. In this apparatus, the gas is utilized to operate an air motor of the eccentric, sliding vane type, and this motor is connected through a centrifugal clutch, belt drive and gear reducer to a crank which actuates the walking beam. In order to return the gas used for operating the air motor back to the sales line, the wellhead pressure must be much higher than the sales line pressure so that the pressure in the exhaust from the motor still exceeds the back pressure in the sales line.

SUMMARY OF THE INVENTION

The present invention uses gas pressure from the well to pump out the liquid in a rapid and efficient manner eliminating the described disadvantages. The gas is directed alternately into the opposite end of a hydraulic cylinder to effect reciprocation of the walking beam. The pneumatic cylinder thus has a power stroke in each direction. This power stroke is utilized to partially recompress the gas whose energy was used to impart the previous power stroke, this gas being recompressed sufficiently to inject it into the sales line. In this way, a relatively small pressure drop of only a few pounds differential between wellhead pressure and sales line pressure can be utilized to accomplish the pumping out of liquids from the well.

The gas from the well at casing head pressure is directed through a two-position directional control valve to a pneumatic cylinder having a piston rod connected to the beam of a walking beam pump. The directional control valve has two pressure lines each connected to opposite ends of the pneumatic cylinder for alternately applying gas pressure to opposite sides of the cylinder piston. The directional control valve is selectively moved to its two positions by a pneumatic actuator supplied with gas under pressure from the casing head and having a thimble valve responsive to the up and down movements of the walking beam to supply an upward power stroke when the rear end of the walking beam reaches its desired lowermost position, and a downward power stroke when the rear end of the walking beam reaches its desired uppermost position.

Control over the length of pump stroke is provided by a rod carried by the walking beam and having adjustable stops thereon formed to engage and move the thimble valve between terminal positions for reversing the directional control valve. A pressure line from the well casing is connected to the directional control valve to supply gas under pressure from the well selectively through either of the two pressure lines to the pneumatic cylinder. The energy of compression is thereby applied to the piston which in turn applies it to the walking beam to accomplish the desired pumping of liquids from the well.

When the directional control valve supplies gas under pressure to one side of the piston, it connects the cylinder on the other side of the piston to a conduit leading to the sales line. As the piston is urged toward the latter end of the cylinder, the gas therein is recompressed sufficiently for it to flow through the directional control valve and into the sales line. Thus, after being used to accomplish one stroke of the pneumatic cylinder, the gas is partially recompressed by the return stroke and injected into the sales line so that no gas is lost or wasted. Also, the energy of compression is conserved because the only such energy used is that utilized to drive the walking beam.

The walking beam is counter-balanced at the end opposite the end on which the horsehead is mounted, the counter-balancing being provided by conventional counter-weights or by an air cylinder actuated by the movement of the walking beam and operative to store energy by compression of air during the downstroke of the pump. The counter-weights store energy by being lifted higher during the downward portion of the pumping cycle, and this stored energy is utilized automatically to help lift the pump piston and liquid during the upward part of the pumping cycle so as to counter-balance the effects of gravity on the pump string and column of liquid being pumped. Similarly, in the embodiment using a counter-balance air cylinder, the downward portion of the pumping cycle compresses air in the cylinder. During the upward stroke of the pumping cycle, the compressed air expands to urge the piston upwardly and impart counter-balancing force to the walking beam. An accumulator reservoir is provided for storing the compressed air, preferably by forming the supporting skid with interconnected hollow members.

It is therefore a principle object of the present invention to provide an apparatus capable of utilizing pressure from gas producing wells to operate a walking beam pump in a novel and efficient manner.

Another object of the present invention is to provide an apparatus of the character described which automatically recompresses and returns the gas utilized for pumping to the sales line so as to avoid loss or waste.

A further object of the present invention is to provide an apparatus of the character described which is capable of operating on a relatively small pressure drop between casing head pressure and sales line pressure.

A still further object of the present invention is to provide, in an apparatus of the character described, a novel accumulator or energy storage reservoir incorporated into the structural supports for the pumping unit.

Other objects, advantages and novel features of the present invention will become apparent from the following detailed description of the invention when considered in conjunction with the accompanying drawing.

DESCRIPTION OF THE PREFERRED EMBODIMENT

Figure 1:
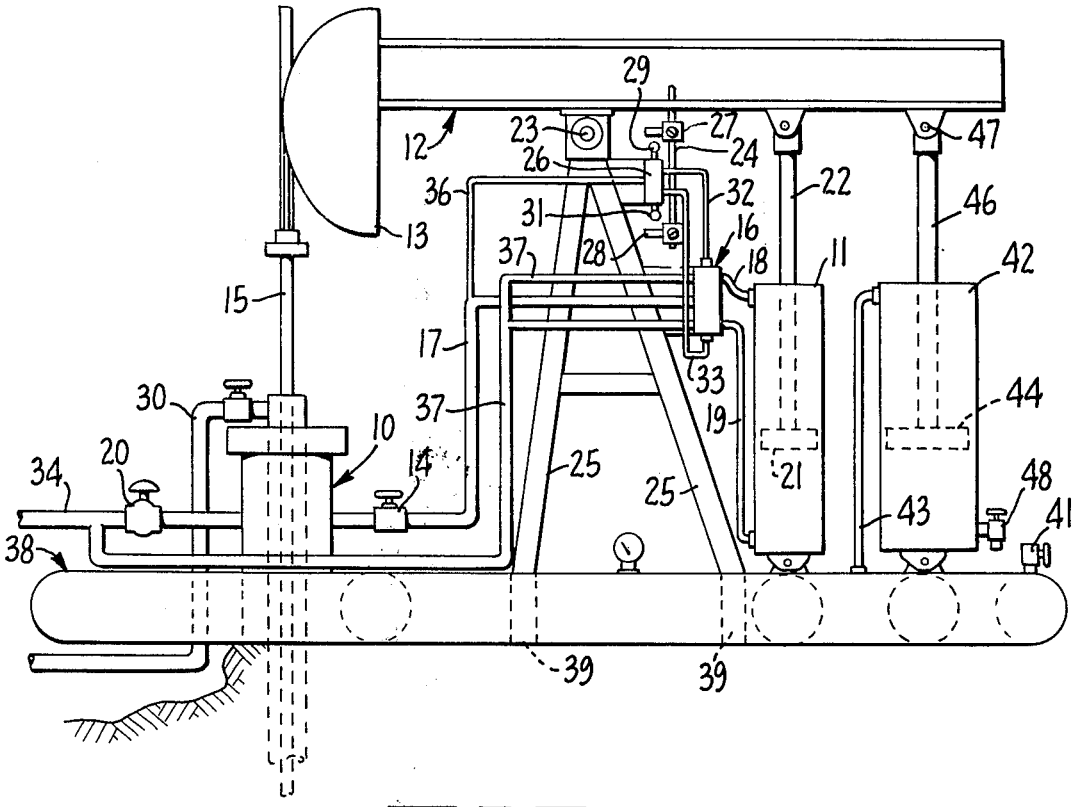
FIG. 1 is a side elevational view of a pneumatic beam pumping unit constructed in accordance with the present invention and having an air cylinder counter-balance.

As may be seen in the accompanying drawing, the apparatus for pumping liquids from gas producing wells of the present invention comprises a well pumping unit having a reciprocably tilting walking beam 12, a pneumatic cylinder 11 having a piston 22 connected to the walking beam, valve means 16 adapted for connection to the well casing head 10 for receiving gas under pressure therefrom and for connection to a gas sales line 34, and conduits 18 and 19 connecting the valve means 16 to the opposite ends of the cylinder 11, the valve means 16 being formed for selectively supplying gas under pressure to an end of the cylinder 11 and for connecting the other end of the cylinder to the sales line 34 whereby movement of the piston 21 toward such other end of the cylinder forces gas therefrom and into the sales line 34, the valve means 16 being responsive to tilting movement of the walking beam 12 to alternate the cylinder ends to which gas under pressure is supplied.

In accordance with conventional walking beam pump practice, a horsehead 13 is mounted on one end of the walking beam and is provided with a pump bridle connected to a polish rod 15 which reciprocates vertically in the wellhead casing 10. The oscillatory movement of the horsehead 13 as the walking beam pivots on shaft 23 imparts pumping energy to the well to pump liquid from the casing and through a delivery line 30.

Gas under pressure from the wellhead is passed through a throttling valve 14 through a supply conduit 17 to the valve means 16. A back pressure regulator 20 maintains proper operating pressure of wellhead gas supplied to the sales line 34 and hence determines the pressure drop between the gas pressure in the casing and the back pressure in the sales line 34. The pressure conduits 18 and 19 are here shown as being connected to the ends of cylinder 11 adjacent to the piston rod and remote therefrom, respectively. The piston 11 is here shown as being disposed with its axis generally vertical and on the side of pivot 23 opposite to the horsehead 11. The end of piston rod 22 is pivotally attached to walking beam 12, and the lower end of cylinder 11 is pivotally connected to a supporting skid structure 38. In this manner, movement of piston 21 downwardly in cylinder 11 will pull down on walking beam 12 and swing horsehead 13 upwardly around pivot point 23, thus providing the pumping stroke. Conversely, movement of piston 21 upwardly in cylinder 11 will push upwardly against walking beam 12, swinging horesehead 13 downwardly to provide the return stroke.

As an important feature of the invention, when a quantity of gas has been used to move piston 21 upwardly or downwardly in cylinder 11, such gas is recompressed by the reverse stroke of the piston, and the valve means 16 permits this recompressed gas to flow through return conduits 37 to the gas sales line 34, or to a suitable gas storage or liquefying unit (not shown). The piston 21 travels quite slowly in the cylinder 11, and pneumatic cylinder practice provides very efficient and long lived sealing against the escape of gas therefrom. This, coupled with the recompression feature of the apparatus, almost completely avoids any wasting or loss of the gas itself, and the relatively low speeds and lack of intervening mechanisms, greatly reduce friction losses.

In accordance with the present invention, the valve means 16 includes a two-position directional control valve, the setting of which is accomplished by pneumatic actuator means operatively connected to the walking beam and formed for moving the directional control valve selectively to the two positions which supply gas under pressure to the two ends of cylinder 11, the pneumatic actuator means acting to move the directional control valve and reverse its setting as the walking beam reaches the desired limits of its stroke.

As here shown, the pneumatic actuator means is responsive to a selector means including a thimble valve 26 mounted on a standard 25 supported on cross members 39 of the skid structure 38. The thimble valve 26 is provided with a reciprocable valving element having portions 29 and 31 extending above and below the valve body for reciprocating the valving element between first and second terminal positions. A rod 24 is secured to the walking beam 12 in proximity to the thimble valve 26, and a pair of stop members 27 and 28 are carried on said rod for engaging the portions 29 and 31 so as to move the valving element correspondingly in accordance with up and down movement of the rod 24 secured to the walking beam.

Figure 2A:
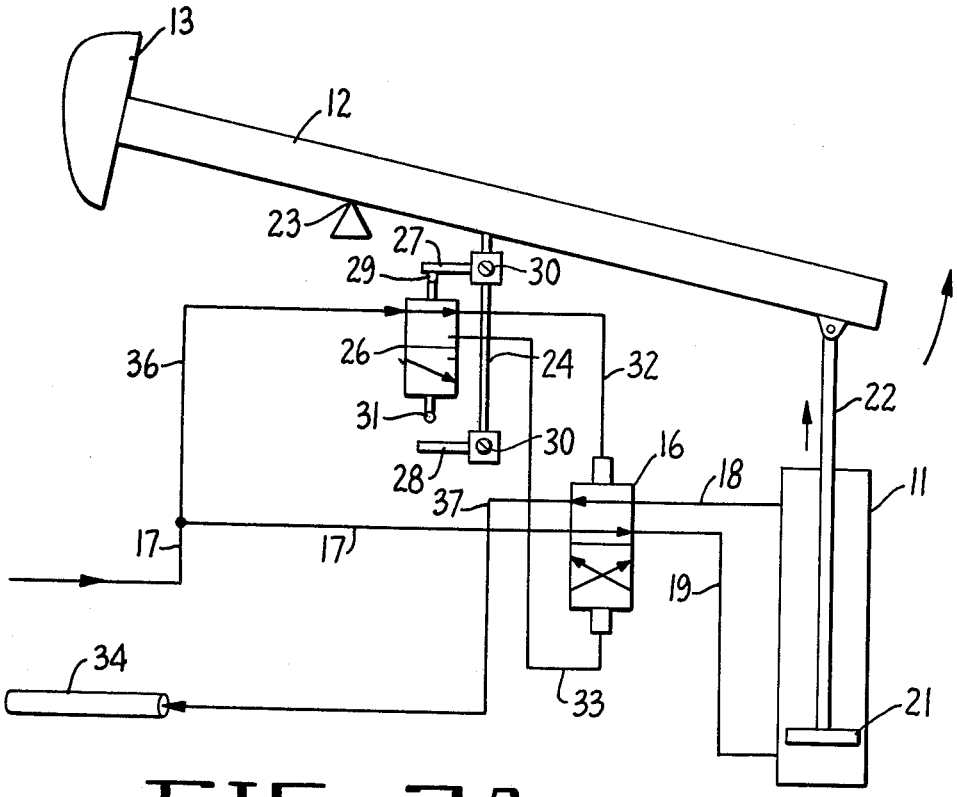
FIGS. 2A and 2B are schematic diagrams of the control system utilized in the apparatus of FIG. 1.
Figure 2B:
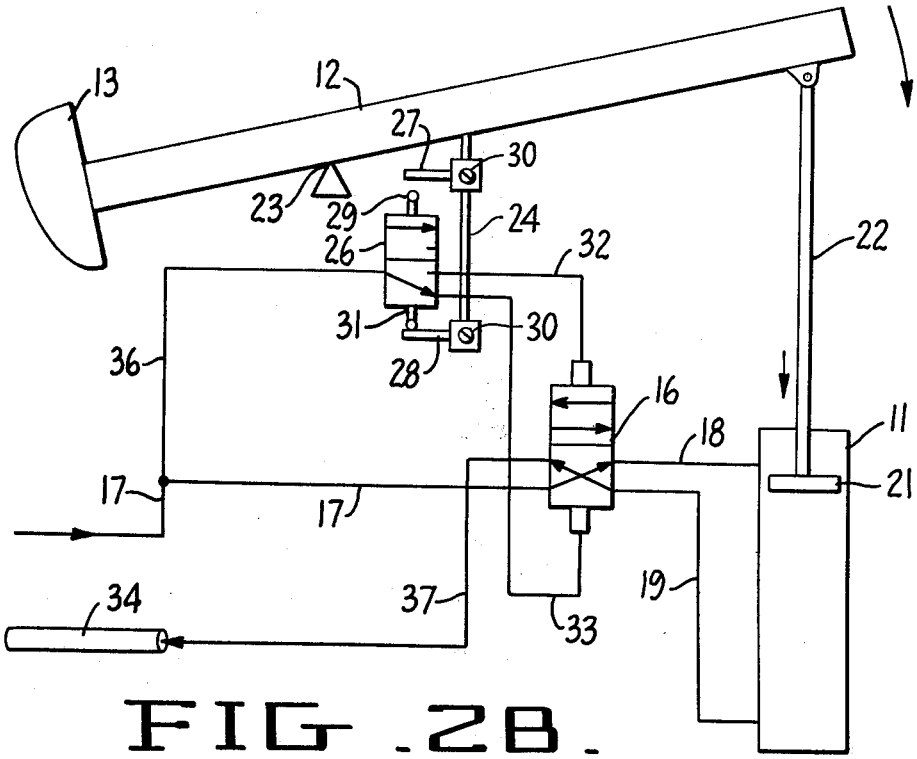

The operation of the control system is shown in greater detail in the schematic diagram of FIGS. 2A and 2B. As shown in FIG. 2A, when the stop 27 moves downwardly, it engages and displaces portion 29 downwardly causing the valving element to supply pressure through control line 32 to the directional control valve 16. Under such circumstances, control valve 16 supplies gas under pressure through line 19 to the lower end of cylinder 11. This forces the piston 21 upwardly in cylinder 11 to reverse the direction of movement of the walking beam 12 and to recompress the gas in the upper end of cylinder 11 sufficiently for it to be forced through line 18 and conduit 37 into the sales line 34 against the back pressure in the sales line.

As rod 24 attached to walking beam 12 moves upwardly, stop 28 eventually engages portion 31, moving the valving element of valve 26 to its other terminal position. In this position, valve 26 supplies gas under pressure from line 36 through line 33 to the lower end of directional control valve 16, causing the valve member thereof to move to its other terminal position. In this position, line 18 is connected to wellhead pressure through line 17, and line 19 is connected through return conduit 37 to the sales line 34. Thus, the vertical distance through which walking beam 12 swings around pivot 23 is determined by the positioning of the stops 27 and 28. These stops are mounted for adjustable positioning on rod 24 and are releasably held in the desired adjustment by set screws 30 so that the upper and lower limits of the pump stroke can readily be adjusted on an individual basis.

Figure 3:
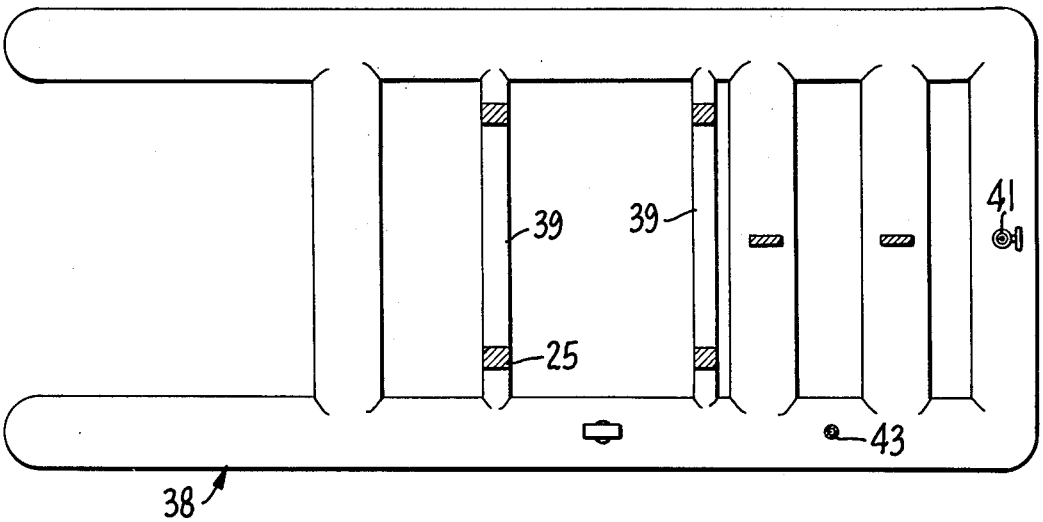
FIG. 3 is a plan view of the skid on which the unit disclosed in FIG. 1 is mounted.

The pumping unit shown in FIG. 1 is mounted on a skid 38 shown in greater detail in FIG. 3. The skid has several solid cross beams 39 with the remaining parts of the skid being hollow. The skid has a valve 41 to inject air therein. A counter-balance cylinder 42, as shown in FIG. 1, is mounted between the skid and the end of the beam 12 with a conduit 43 connected from the top of the cylinder to the hollow portion of the skid. The counter-balance cylinder 42 has a piston 44 formed at the end of a connecting rod 46 which is mechanically linked to the beam 12 at linkage 47.

The counter-balance cylinder is operative to store energy therein during the downstroke part of the pumping cycle. The piston 44 compresses air through conduit 43 into the hollow portions of the skid 38. During the upstroke portion of the pumping cycle, the beam 12 rotates in a clockwise direction and the compressed air in the skid urges piston 44 downward thereby reducing the force required by the pneumatic cylinder 11 to pump the fluids from the well. The air in the cylinder 42 beneath the piston 44 is vented to the atmosphere through a vent 48.

Figure 4:
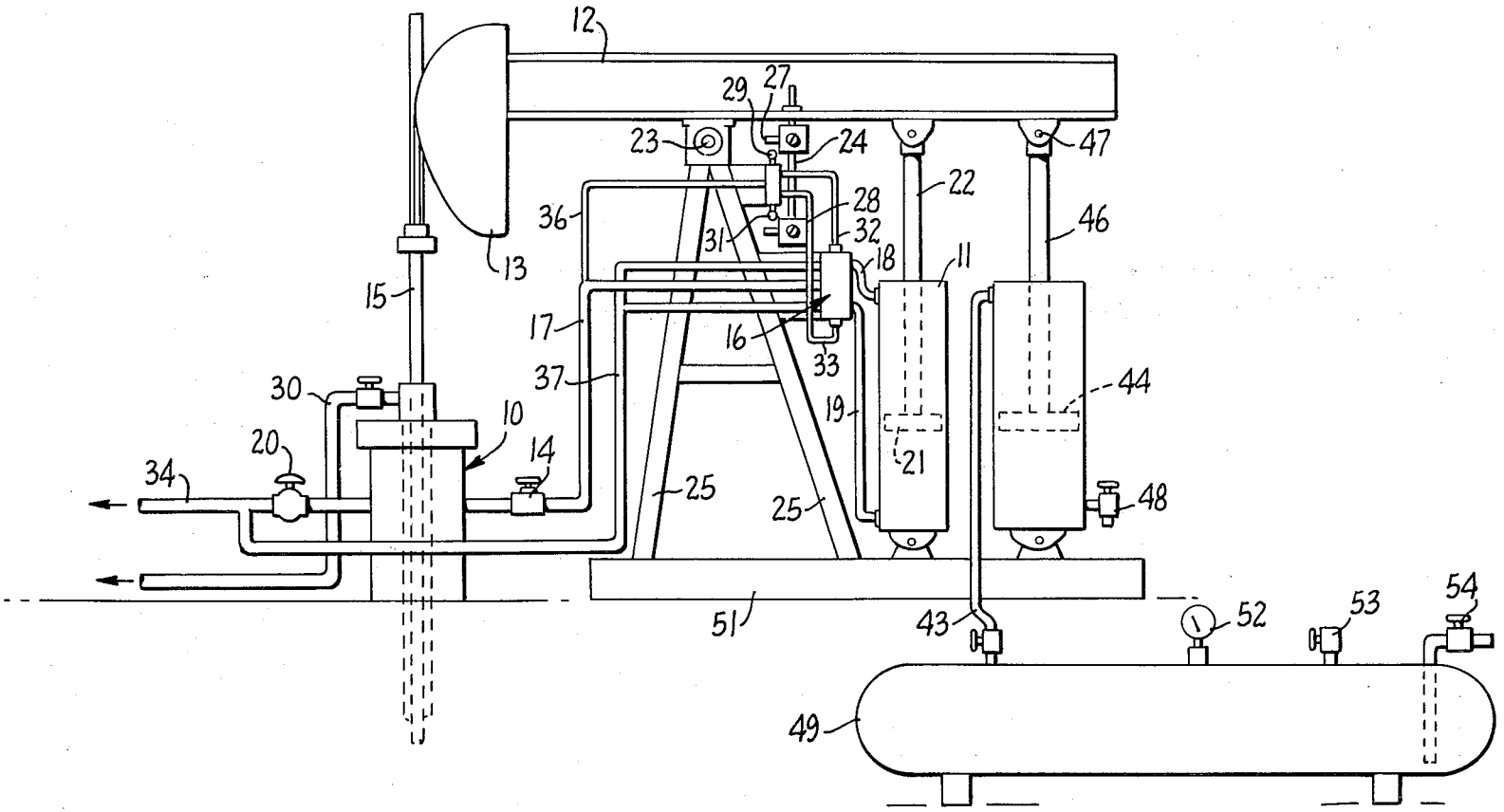
FIG. 4 is a side elevational view of another embodiment of the pneumatic beam pumping unit of the present invention having a separate volume tank operative in conjunction with the counter-balance air cylinder.

The pumping unit in FIG. 4 is similar to the one shown in FIG. 1 except that the volume tank 49 shown in FIG. 4 is not an integral portion of this skid 38 shown in FIG. 1. A separate skid 51 is used in the unit shown in FIG. 4. The volume tank 49 has a pressure gauge 52, and an opening valve 53 to inject air into the tank and a volume tank drain 54.

Figure 5:
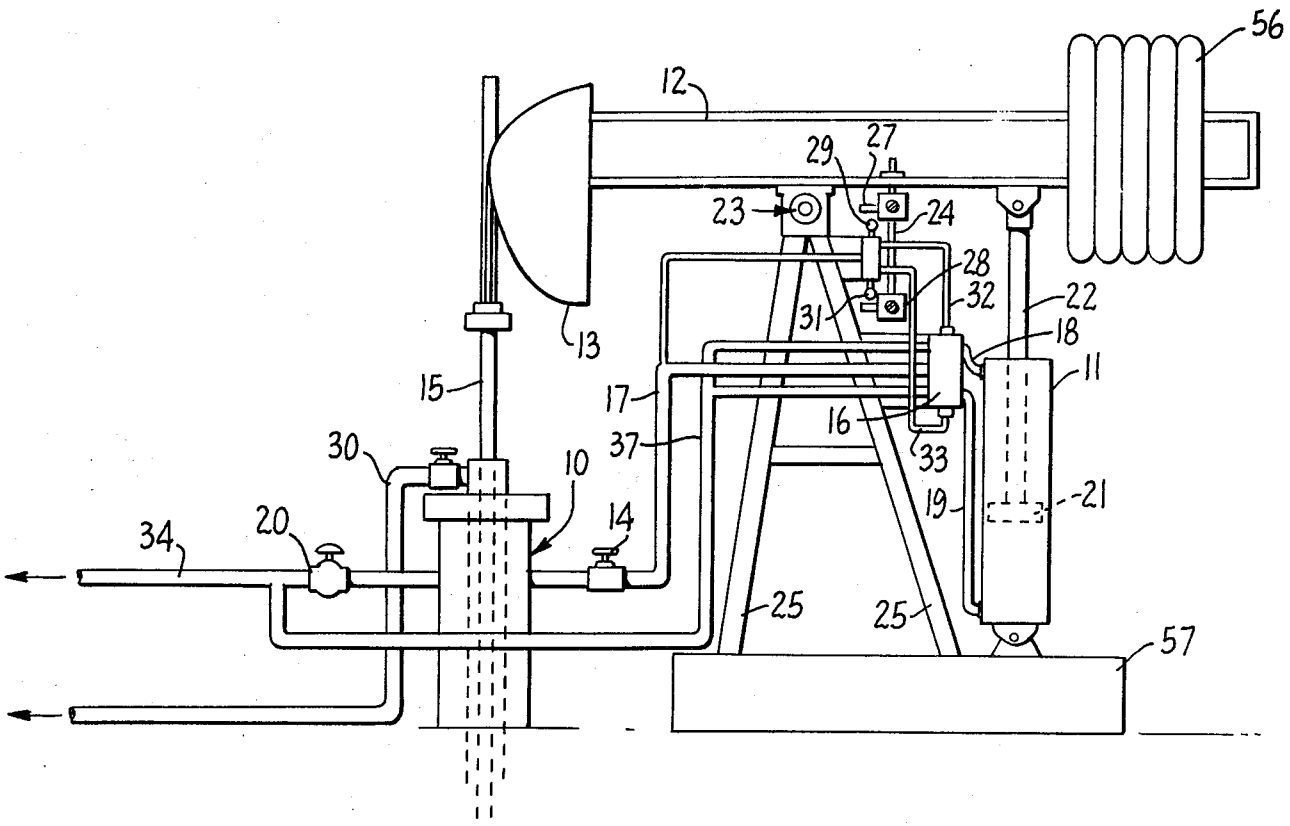
FIG. 5 is a side elevational view of another embodiment of the pneumatic beam pumping unit of the present invention using weights for counter balance.

The pneumatic beam pumping unit shown in FIG. 5 is similar to the unit shown in FIG. 1 except that the unit in FIG. 5 employs counter weights 56 rather than a counter-balance cylinder. The counter weights 56 are similar to the counter-balance cylinder in that the potential energy of the counter weights is increased during the downstroke portion of the cycle by the lifting of the counter weights as the beam 12 rotates counterclockwise. During the upstroke of the pump, the weight of the counter weights 56 is converted into kinetic energy by the rotation of the beam 12 clockwise. The lowering of the counter weights 56 during this upstroke reduces the amount of pressure that must be applied to piston 11 to effect this upstroke of the pump. The unit in FIG. 5 may be mounted on any suitable skid 57. Of course, since there is no counter-balance cylinder in FIG. 5, the unit does not require any volume tank.

It is apparent from the above description that the present invention is operative to utilize gas pressure from any gas producing well to operate a pump for extracting liquids from the well. In the operation of the invention, the amount of pressure required in the cylinder 11 need be only slightly greater than the pressure in the output gas pipeline 34. This pressure differential is maintained by pressure regulator 20 on the output gas pipeline as shown.

From the foregoing, it will be seen that the pneumatic beam pumping unit of the present invention is particularly valuable in its ability to operate automatically and unattended over long periods of time and using energy of compression from the well being pumped. Moreover, the present apparatus is valuable in conserving scarce fossil fuel energy by reason of its capacity for returning the gas used for pumping to the sales line, with only a slight pressure drop from well to sales line being required. Likewise, the apparatus operates in such manner as to utilize minimum energy of compression and is free from leakage or wasting of the gas.

I claim;

1. Apparatus for pumping liquids from gas producing wells, comprising a well pumping unit having a reciprocably tilting walking beam, a pneumatic cylinder having a piston connected to said walking beam, valve means adapted for connection to the well casing head for receiving gas under pressure therefrom and for connection to a gas sales line, and conduits connecting said valve means to the opposite ends of said cylinder, said valve means being formed for selectively supplying gas under pressure to an end of said cylinder and for connecting the other end of said cylinder to the sales line whereby movement of said piston toward said other end of said cylinder forces gas therefrom and into said sales line, said valve means being responsive to tilting movement of said walking beam to alternate the cylinder ends to which gas under pressure is supplied.

2. An apparatus as described in claim 1 and wherein said valve means includes a two-position directional control valve, and pneumatic actuator means operatively connected to said walking beam and formed for moving said directional control valve selectively to its two positions as said walking beam reaches the desired limits of its stroke.

3. An apparatus as described in claim 2 and wherein said pneumatic actuator means is adapted for connection to the well casing head to obtain gas under pressure therefrom for operating said pneumatic actuator means.

4. An apparatus as described in claim 3 and wherein said pneumatic actuator means comprises a control valve having a control member movable between first and second positions causing actuation of said valve means to supply gas under pressure to first and second ends of said cylinder respectively, first and second stops carried by said walking beam for movement therewith and formed for engaging and moving said control member between said first and second positions in accordance with the movement of said walking beam.

5. An apparatus as described in claim 4 and wherein said stops are adjustably mounted on said walking beam whereby the angular deflection of the walking beam and the resulting pump stroke may be changed as desired.

6. An apparatus as described in claim 1 and further comprising counter-balance means operatively associated with said walking beam and formed for storing energy on the downstroke of a pump of said well unit to aid the upstroke of the pump with the amount of energy stored being proportional to the distance of the pump stroke.

7. An apparatus as described in claim 6 and wherein said counter-balance means comprises a weight adjustably mounted on the end of said walking beam opposite to said horsehead.

8. An apparatus as described in claim 6 and wherein said counter-balance means comprises a lineal pneumatic pump operatively connected to the end of said walking beam opposite to said horsehead, and an accumulator reservoir connected to said pneumatic pump for storing air compressed by said pump on the downstroke of the pump and releasing the energy of such air to assist the upward stroke of the pump.

9. An apparatus as described in claim 8 and wherein said apparatus is mounted on a skid structure, and a portion of said skid structure is hollow to provide said accumulator reservoir.

10. Apparatus for pumping liquids from gas producing wells, comprising a skid structure for supporting the apparatus in operative association, a standard mounted on said skid structure and having a bearing thereon, a walking beam journaled in said bearing for teetering movement and having a horsehead at one end adapted to support a pump bridle, a substantially vertically disposed pneumatic drive cylinder having a piston reciprocable therein and a vertically extending piston rod, the distal end of said piston rod and the end of said cylinder remote therefrom being pivotally connected to said walking beam and said skid structure, a direction control valve providing valve housing, a supply conduit adapted for connection to the casing head of the well for receiving gas under pressure therefrom and communicating with the interior of said valve housing, a pair of pressure conduits communicating the interior of said valve housing with the opposite ends of said drvie cylinder, an injection conduit adapted for connection to a gas sales line and communicating with the interior of said valve housing, a valve member in said valve housing formed for reciprocation between a first terminal position connecting said pressure conduit for the upper end of said drive cylinder to said supply conduit and the lower end of said cylinder to said injection conduit and a second terminal position connecting said pressure conduit for the lower end of said drive cylinder to said injection conduit, a pneumatic actuator on said direction control valve formed for moving said valve member into said first and second terminal positions, and selector means on said standard and walking beam responsive to movement of the latter for operating said pneumatic actuator to select between said first and said terminal positions of said valve member in accordance with the position of said walking beam relative to said skid structure.

11. An apparatus as described in claim 10 and wherein said selector means is adjustable for selectively varying the length of stroke of said walking beam.

12. An apparatus as described in claim 11 and wherein said selector means comprises a thimble valve mounted on said standard and having a reciprocable valving element providing portions extending above and below a valve body for reciprocating said valving element between first and second terminal positions, an actuator supply conduit adapted for connection to the wellhead for receiving gas under pressure therefrom and communicating with said valve body, a pair of actuator pressure conduits communicating said valve body with opposite ends of said pneumatic actuator in accordance with the location of said valving element in its terminal positions, a rod secured to said walking beam in proximity to said thimble valve, and a pair of stop members on said rod formed for engaging said portions and moving said valving element correspondingly in accordance with movement of said walking beam.

13. An apparatus as described in claim 12 and wherein said stop members are adjustably movable along said rod for selectively controlling the upper and lower limits of the stroke of a pump.

14. An apparatus as described in claim 10 and wherein said apparatus further comprises counter-balance means operatively associated with said walking beam and formed for storing energy on the downstroke of the pump to aid the upstroke of the pump with the amount of energy stored being proportional to the distance of the pump stroke.

15. An apparatus as described in claim 14 and wherein said counter-balance means comprises a weight adjustably mounted on the end of said walking beam opposite to said horsehead.

16. An apparatus as described in claim 10 and wherein said counter-balance means comprises a lineal pneumatic pump operatively connected to the end of said walking beam opposite to said horsehead, and an accumulator reservoir connected to said pneumatic pump for storing air compressed by said pump on the downstroke of the pump and releasing the energy of such air to assist the upward stroke of the pump.

17. An apparatus as described in claim 16 and wherein said skid structure comprises a plurality of hollow members interconnected to provide said accumulator reservoir.

18. In an apparatus for pumping liquids from gas producing wells, a unit for driving a walking beam comprising a pneumatic cylinder having a piston connected to said walking beam, valve means adapted for connection to the well casing head for receiving gas under pressure therefrom and for connection to a gas sales line, and conduits connecting said valve means to the opposite ends of said cylinder, said valve means being formed for selectively supplying gas under pressure to an end of said cylinder and for connecting the other end of said cylinder to the sales line whereby movement of said piston toward said other end of said cylinder forces gas therefrom and into said sales line, said valve means being responsive to tilting movement of said walking beam to alternate the cylinder ends to which gas under pressure is supplied.

19. A unit as described in claim 18 and wherein said valve means includes a two-position directional control valve, and pneumatic actuator means operatively connected to said walking beam and formed for moving said directional control valve selectively to its two positions as said walking beam reaches the desired limits of its stroke.

20. A unit as described in claim 19 and wherein said pneumatic actuator means is adapted for connection to the well casing head to obtain gas under pressure therefrom for operating said pneumatic actuator means.

21. A unit as described in claim 20 and wherein said pneumatic actuator means comprises a control valve having a control member movable between first and second positions causing actuation of said valve means to supply gas under pressure to first and second ends of said cylinder respectively, first and second stops carried by said walking beam for movement therewith and formed for engaging and moving said control member between said first and second positions in accordance with the movement of said walking beam.

22. A unit as described in claim 21 and wherein said stops are adjustably mounted on said walking beam whereby the angular deflection of the walking beam and the resulting stroke of a pump may be changed as desired.

23. A unit as described in claim 18 and further comprising counter-balance means operatively associated with said walking beam and formed for storing energy on the downstroke of the pump to aid the upstroke of the pump with the amount of energy stored being proportional to the distance of the pump stroke.

24. A unit as described in claim 23 and wherein said counter-balance means comprises a lineal pneumatic pump operatively connected to the end of said walking beam opposite to said horesehead, and an accumulator reservoir connected to said pneumatic pump for storing air compressed by said pump on the downstroke of the pump and releasing the energy of such air to assist the upward stroke of the pump.

25. A unit as described in claim 24 and wherein said apparatus is mounted on a skid structure, and a portion of said skid structure is hollow to provide said accumulator reservoir.

* * * * *